US006768392B2

(12) United States Patent
Makino et al.

(10) Patent No.: US 6,768,392 B2
(45) Date of Patent: Jul. 27, 2004

(54) NONRECIPROCAL CIRCUIT DEVICE AND COMMUNICATION APPARATUS INCORPORATING THE SAME

(75) Inventors: Toshihiro Makino, Nagaokakyo (JP); Masakatsu Mori, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 75 days.

(21) Appl. No.: 10/042,663

(22) Filed: Jan. 9, 2002

(65) Prior Publication Data

US 2002/0053964 A1 May 9, 2002

(30) Foreign Application Priority Data

Dec. 17, 1999 (JP) ..... 11-360020

(51) Int. Cl.[7] ..... H01P 1/32
(52) U.S. Cl. ..... 333/1.1; 333/24.2
(58) Field of Search ..... 333/1.1, 24.2, 333/24.1

(56) References Cited

U.S. PATENT DOCUMENTS 3,324,418 A 6/1967 Caswell
3,466,571 A 9/1969 Jansen et al.
3,621,476 A * 11/1971 Kanbayashi ..... 333/1.1
4,812,787 A 3/1989 Kuramoto et al.

FOREIGN PATENT DOCUMENTS

JP 6-140813 A 5/1994
JP 6-252611 A 9/1994
JP 6-260812 A 9/1994
JP 8-078911 A 3/1996
JP 11-168305 A 6/1999

* cited by examiner

*Primary Examiner*—Lincoln Donovan
(74) *Attorney, Agent, or Firm*—Keating & Bennett, LLP

(57) ABSTRACT

A nonreciprocal circuit device including a metal case through which a high frequency current is difficult to flow, and a communication apparatus incorporating the nonreciprocal circuit device. The cross section of the metal case has a rectangular-frame shape formed by inwardly bending a substantially rectangular metal plate at four positions at angles of 90 degrees in parallel to the short edges of the metal plate. The top ends of two arms of the metal case are opposed to each other at a specified distance. As a result, the metal case does not form a loop around a permanent magnet and a central electrode assembly.

7 Claims, 9 Drawing Sheets

NONRECIPROCAL CIRCUIT DEVICE AND COMMUNICATION APPARATUS INCORPORATING THE SAME

BACKGROUND OF THE INVENTION

1. Field of the Invention

The present invention relates to nonreciprocal circuit devices, and more particularly, it relates to nonreciprocal circuit devices such as isolators and circulators used in microwave bands, and communication apparatuses incorporating the nonreciprocal circuit devices.

2. Description of the Related Art

In general, a lumped-constant isolator adopted in a mobile communication apparatus such as a mobile phone passes a signal only in a direction in which the signal is transmitted, while blocking the signal transmission in the opposing direction. In addition, in the recent mobile communication apparatus, compact, lightweight, and low-priced products have been strongly demanded. With this tendency, a compact, lightweight, and low-priced isolator has been demanded.

As the lumped-constant isolator, there is known a device such as a lump-constant isolator 11 shown in FIG. 13. In the lump-constant isolator 11, a resin terminal case 13 is disposed on a metal lower case unit 12 having left and right walls 12*a* and a bottom wall 12*b*. A central electrode assembly 14 is contained in the terminal case 13, and a metal upper case unit 15 is disposed on the structure. A permanent magnet 16 is attached to the inner surface of the metal upper case unit 15. With the permanent magnet 16, a direct current magnetic field is applied to the central electrode assembly 14.

The central electrode assembly 14 is arranged by crossing three central electrodes 21 to 23 electrically insulated from each other at angles of 120 degrees on the upper surface of a microwave ferrite member 20. Ports P1 to P3 of ends of the three central electrodes 21 to 23 are horizontally extracted, and a common shield part of the other ends thereof is in contact with the lower surface of the ferrite member 20. The common shield part, which substantially covers the lower surface thereof, is connected to the bottom wall 12*b* of the lower case unit 12 via a window 13*a* of the terminal case 13.

The ports P1 to P3 of the central electrodes 21 to 23 are connected to the hot-side capacitor electrodes of matching capacitors C1 to C3. An end of a terminating resistor R is connected to the hot-side capacitor electrode of the matching capacitors C3. The central electrode assembly 14 and the capacitors C1 to C3 are contained in the terminal case 13. Then, as shown in FIG. 14, the edges of two parts where the upper case unit 15 and the lower case unit 12 are close to each other (areas shown by vertical lines in FIG. 14) are connected by solder 18 (see FIG. 15).

Meanwhile, the conventional isolator 11 forms a frame-like loop structure around the permanent magnet 16 and the central electrode assembly 14 in the upper case unit 15 and the lower case unit 12. Thus, as shown in FIG. 15, a high frequency current i is likely to go around the upper and lower case units 15 and 12. As a result, there is a problem of power consumption due to Joule loss. Moreover, the high frequency current i flowing through the case units 15 and 12 serves to cancel a regular signal current I flowing through the central electrodes 21 to 23. In other words, the high frequency current i serves to reduce a high frequency magnetic field generated by the ferrite member 20. As a result, the effective inductances of the central electrodes 21 to 23 and the effective magnetic permeability of the ferrite member 20 are reduced, thereby narrowing the operational frequency bandwidth of the isolator 11.

SUMMARY OF THE INVENTION

Accordingly, it is an object of the present invention to provide a nonreciprocal circuit device including a metal case through which a high frequency current is difficult to flow. In addition, it is another object of the present invention to provide a communication apparatus incorporating the nonreciprocal circuit device.

In order to accomplish the above objects, the present invention provides a nonreciprocal circuit device including a permanent magnet, a ferrite member which is adapted to receive a direct current magnetic field applied by the permanent magnet, the ferrite member including a plurality of central electrodes, and a metal case containing the permanent magnet, the ferrite member, and the plurality of central electrodes. In this nonreciprocal circuit device, the metal case has a gap for cutting off a loop current flowing around the ferrite member and the plurality of central electrodes.

In this case, a "gap" means an electrical gap. The gap of the present invention also includes a gap in which an insulating material is filled. In such a situation, although there is physically no gap, there is no electrical connection.

For example, the cross section of the metal case may have a substantially rectangular frame or cylindrical shape by bending a substantially rectangular metal plate at four positions in parallel to an edge of the metal plate. In addition, the metal case may be constituted of an upper case unit and a lower case unit. There may be disposed a gap at least between one edge of the upper case unit and an edge of the lower case unit opposite to the edge of the upper case unit. Furthermore, preferably, the metal case is set to be rotation-symmetrical with respect to the axis of the permanent magnet.

With the above arrangement, since a high frequency current flowing through the metal case is cut off by the gap disposed in the metal case, the high frequency current is difficult to flow through the metal case.

In addition, since the communication apparatus incorporating the above nonreciprocal circuit device in accordance with the present invention can have good frequency characteristics.

DESCRIPTION OF THE PREFERRED EMBODIMENTS

The embodiments of a nonreciprocal circuit device and a communication apparatus in accordance with the present invention will be described below with reference to the attached drawings.

[First Embodiment: FIGS. 1 to 6]

Figure 1:
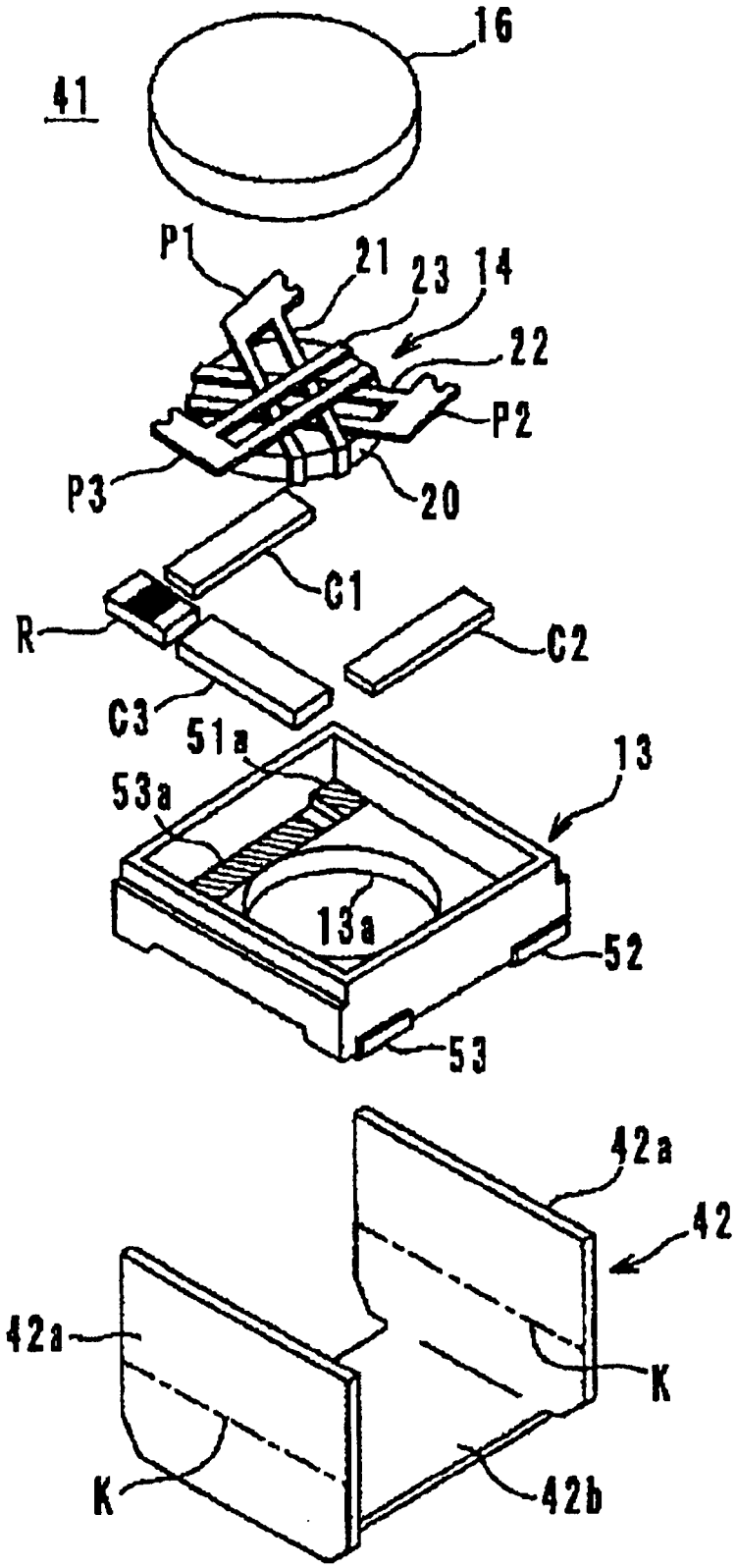
FIG. 1 is an exploded perspective view of a nonreciprocal circuit device according to a first embodiment of the present invention.

FIG. 1 shows an exploded perspective view showing the structure of a nonreciprocal circuit device according to an embodiment of the present invention. A nonreciprocal circuit device 41 is obtained by applying the present invention to the lumped-constant isolator shown in FIG. 13. As shown in FIG. 1, the lumped-constant isolator 41 includes a resin terminal case 13, a central electrode assembly 14, a permanent magnet 16, and a metal case 42.

Figure 2:
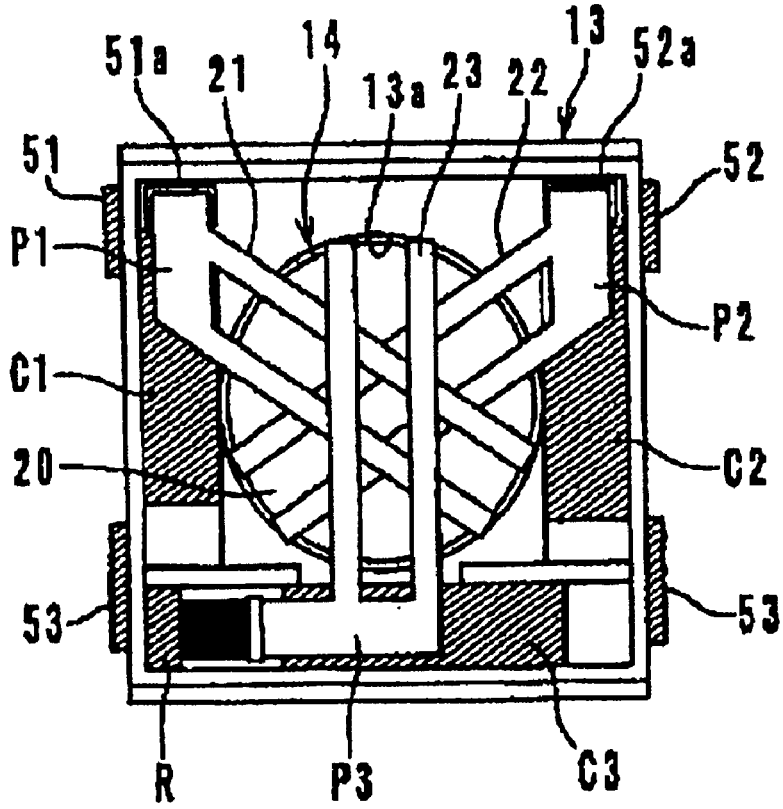
FIG. 2 is a plan view of a central electrode assembly of the nonreciprocal circuit device shown in FIG. 1.

As shown in FIG. 2, input/output terminals 51 and 52, and ground terminals 53 are insert-molded in the terminal case 13. An end of each of the input/output terminals 51 and 52 is exposed on an external surface of the case 13, and the remaining end of each of thereof is exposed on an internal surface of the case 13 to form input/output connection electrode portions 51*a* and 52*a*. Similarly, two ends of the ground terminals 53 are exposed on the mutually opposing external-wall surfaces of the case 13, and the remaining ends thereof are exposed on the internal surfaces of the case 13 to form ground connection electrode portions 53*a* (see FIG. 1).

The central electrode assembly 14 is arranged by crossing three central electrodes 21 to 23 electrically insulated from each other at the angles of 120 degrees on the upper surface of a microwave ferrite member 20 as a first main surface and one magnetic pole surface. Ports P1 to P3 of the ends of the three central electrodes 21 to 23 are horizontally extracted, and a common shield part of the other ends thereof is in contact with the lower surface of the ferrite member 20 as a second main surface and the other magnetic pole surface. The common shield part, which substantially covers the lower surface of the ferrite member 20, is connected to the bottom 42*b* of a metal case 42, which will be described below, via a window 13*a* of the terminal case 13 by a method such as soldering.

The hot-side capacitor electrodes of matching capacitors C1 to C3 are connected to the ports P1 to P3 of the central electrodes 21 to 23 by soldering. The cold-side capacitor electrodes thereof are connected to the ground connection electrode portions 53*a* exposed on the internal surfaces of the terminal case 13 by soldering. An end of a terminating resistor R is connected to the hot-side capacitor electrode of the matching capacitors C3. The remaining end thereof is connected to the ground connection electrode portion 53*a*. Consequently, the matching capacitor C3 and the terminating resistor R are electrically connected in parallel between the port P3 of the central electrode 23 and the ground.

The metal case 42 is formed of a piece of substantially rectangular magnetic metal plate. The metal plate is bent at two positions in advance at angles of 90 degrees in parallel to the short edges of the metal plate. The central part of the metal case 42 is a bottom 42*b*, and the left and right parts of the metal case 42 are two arms 42*a*. The terminal case 13 is disposed on the bottom 42*b* of the metal case 42 to contain the central electrode assembly 14, the matching capacitors C1 to C3, and the like therein. Then, the two arms 42*a* of the metal case 42 are inwardly folded at angles of 90 degrees along dashed lines K (see FIG. 1) along the outer configuration of the terminal case to cover the opening part of the terminal case 13. In this situation, the permanent magnet 16 is attached on the inner side surface of one of the two arms 42*a*. With the permanent magnet 16, a direct current magnetic field is applied to the central electrode assembly 14. The metal case 42 and the central electrode assembly 14 form a magnetic path.

Figure 3:
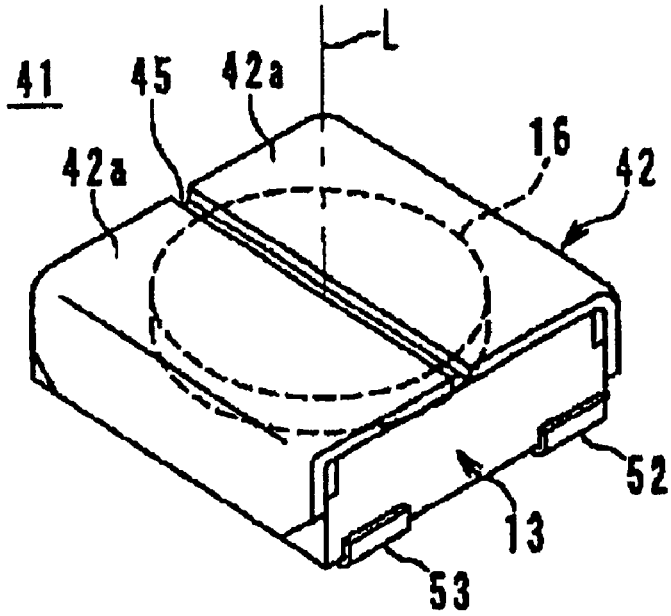
FIG. 3 is a perspective view showing the appearance of the nonreciprocal circuit device shown in FIG. 1.
Figure 4:
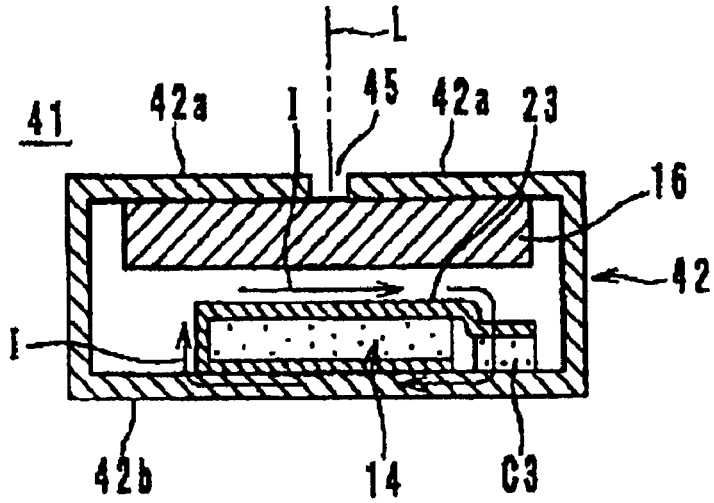
FIG. 4 is a schematic sectional view of the nonreciprocal circuit device shown in FIG. 1.
Figure 5:
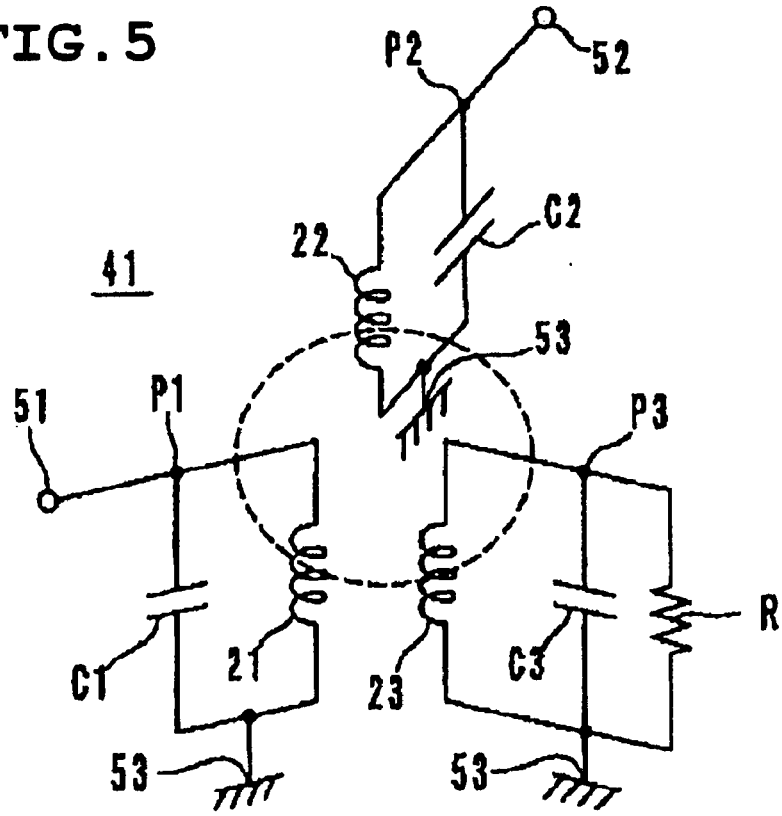
FIG. 5 is an electrically equivalent circuit diagram of the nonreciprocal circuit device shown in FIG. 1.

Each of FIGS. 3 and 4 shows the lumped-constant isolator 41 having the structure obtained in the above arrangement. FIG. 5 is an electrically equivalent circuit diagram of the isolator 41. The cross section of the metal case 42 has a substantially rectangular shape and the metal case 42 has a frame or cylindrical shape formed by inwardly bending a substantially rectangular metal plate at four positions at angles of 90 degrees in parallel to short edges of the metal plate. The top ends of the two arms 42*a* of the metal case 42 are opposed to each other while leaving a gap 45 having a predetermined distance therebetween. In other words, the metal case 42 does not form a loop around the permanent magnet 16 and the central electrode assembly 14. As a result, a loop current, which flows around the permanent magnet 16 and the central electrode assembly 14, that is, a high frequency current i flowing through the metal case 42 is cut off by the gap 45. Thus, the high frequency current i is difficult to flow through the metal case 42, and the power consumption due to Joule loss can be suppressed. For example, the size of the gap 45 needs to be 0.001 mm or more.

Figure 6:
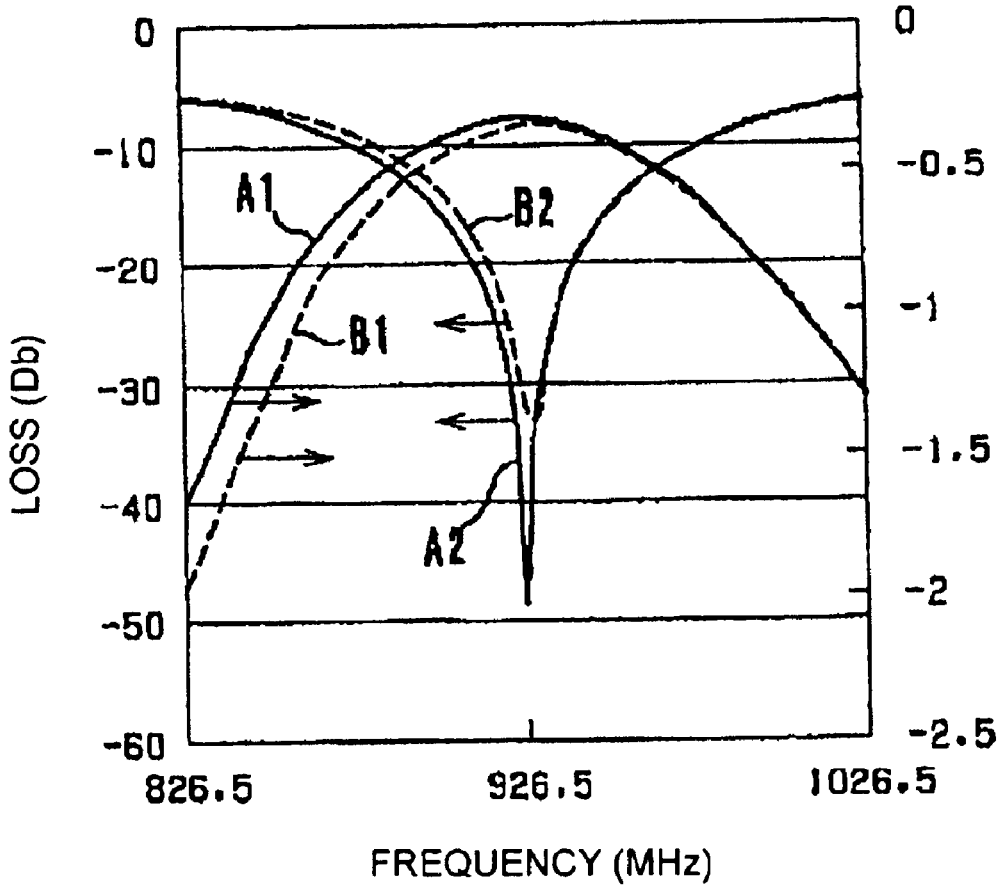
FIG. 6 is a graph showing the forward pass characteristics and isolation characteristics of the nonreciprocal circuit device shown in FIG. 1.

The high frequency current i flowing through the metal case 42 cancels a regular signal current I flowing through the central electrodes 21 to 23 and serves in a manner that a high frequency magnetic field generated by the ferrite member 20 is reduced. However, since the gap 45 is disposed in the metal case 42, the reduction of the high frequency magnetic field can be prevented. As a result, the effective inductances of the central electrodes 21 to 23 and the effective magnetic permeability of the ferrite member 20 increase, and the operational frequency bandwidth of the isolator 41 can thereby be broadened. FIG. 6 is a graph showing results obtained by measuring the forward pass direction characteristics A1 and reverse direction characteristics (isolation characteristics) A2 of the isolator 41. For comparison, the FIG. 6 also shows the forward pass characteristics B1 and reverse characteristics B2 of the conventional isolator 11 of FIG. 13. As shown in FIG. 6, obviously, the operational frequency bandwidth of the isolator 41 is broader than that of the isolator 11.

In addition, the metal case 42 having the gap 45 is designed to be rotation-symmetrical with respect to the central axis L (see FIGS. 3 and 4) of the permanent magnet 16 so that the direct current magnetic field applied to the ferrite member 20 can be efficiently distributed.

Figure 13:
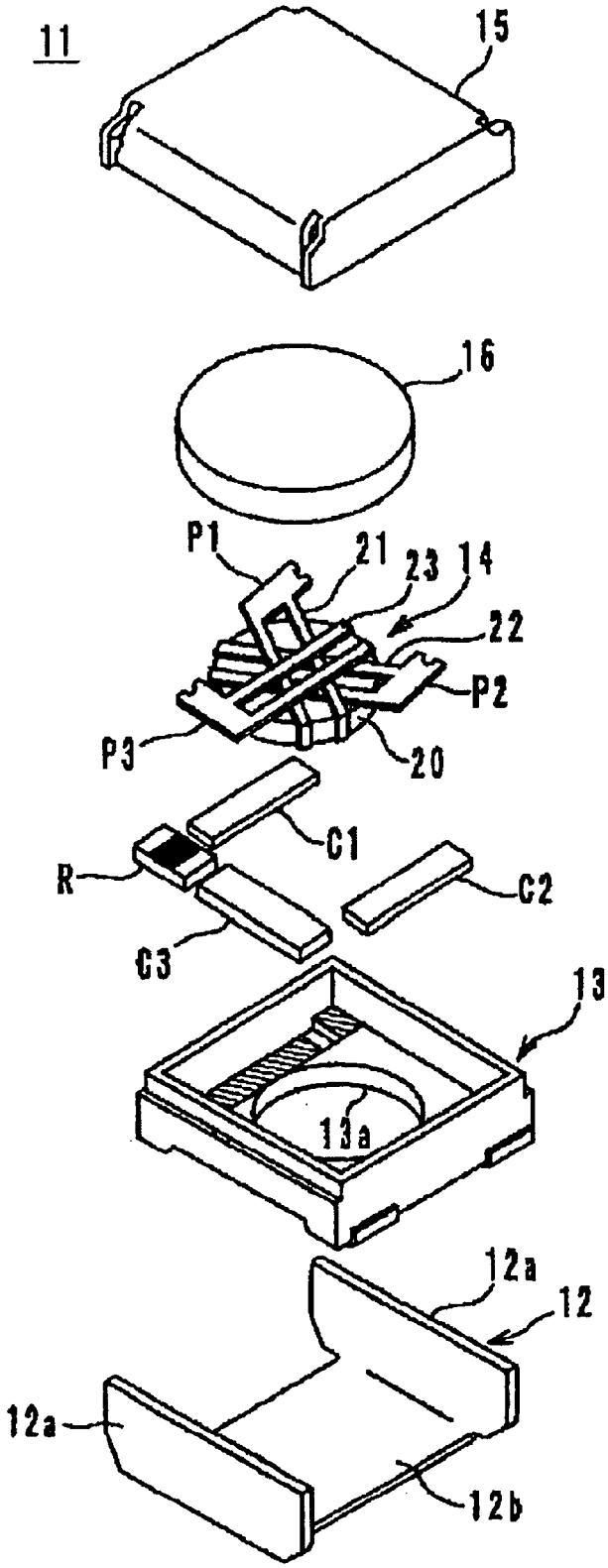
FIG.13 PRIOR ART
FIG. 13 is an exploded perspective view of a conventional nonreciprocal circuit device.
Figure 14:
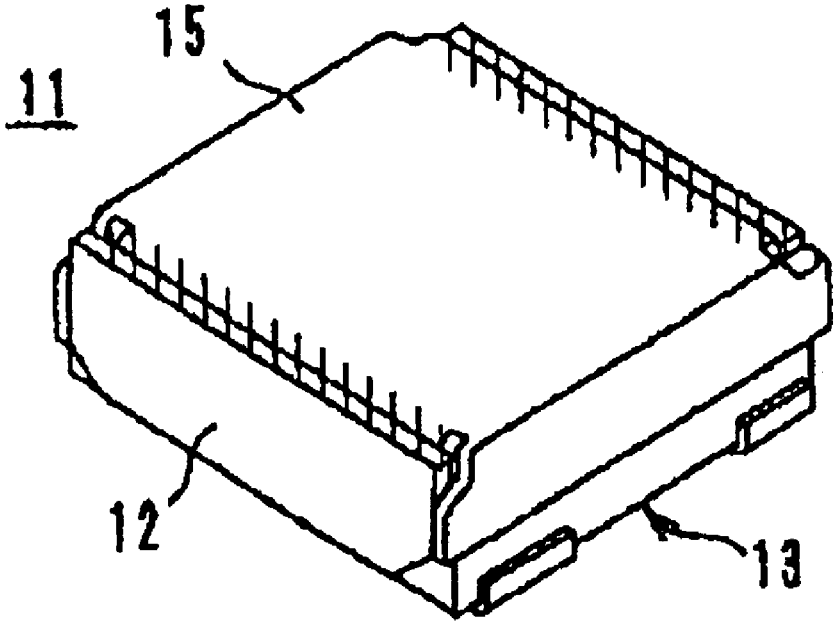
FIG. 14 PRIOR ART
FIG. 14 is a perspective view showing the appearance of the nonreciprocal circuit device shown in FIG. 13.

In addition, since the metal case 42 has an integrally-formed structure, as compared with the combination of the metal-case upper and lower units 12 and 15 used in the conventional isolator 11 shown in FIG. 13, the isolator of the present invention can reduce more magnetic resistance. Moreover, a step of connecting such two metal-case units to each other by soldering is unnecessary.

Figure 7:
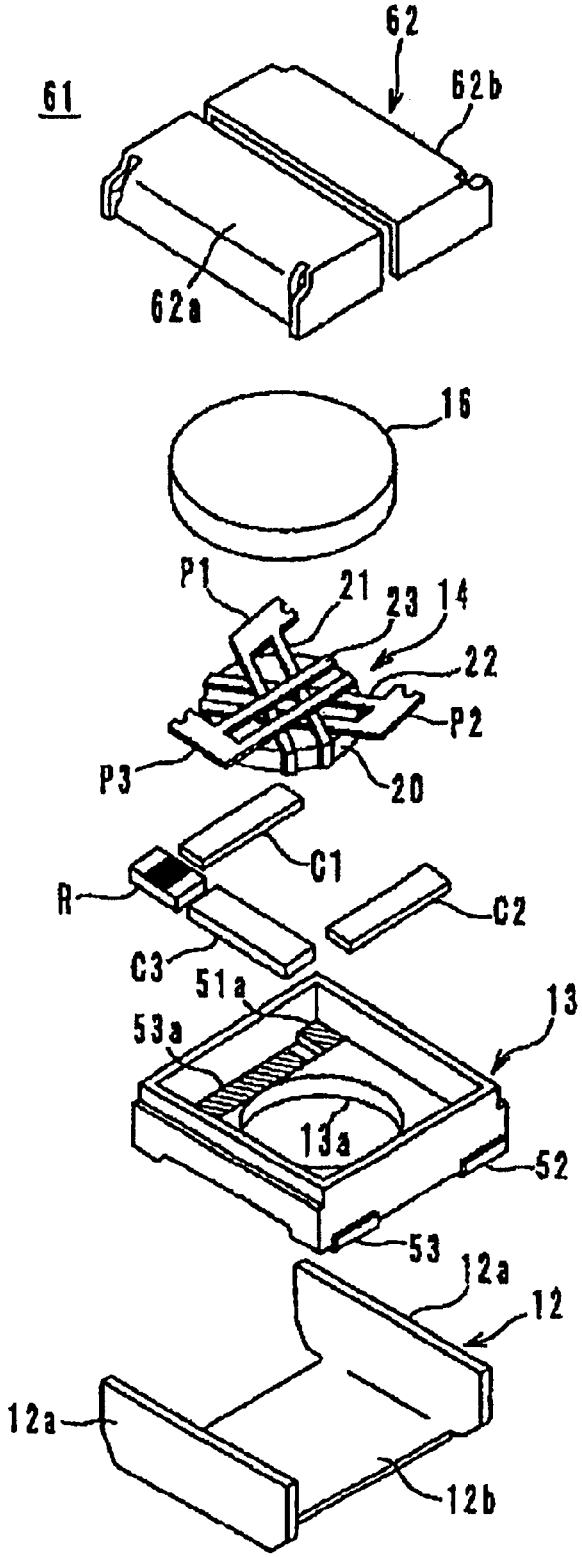
FIG. 7 is an exploded perspective view of a nonreciprocal circuit device according to a second embodiment of the present invention.
Figure 8:
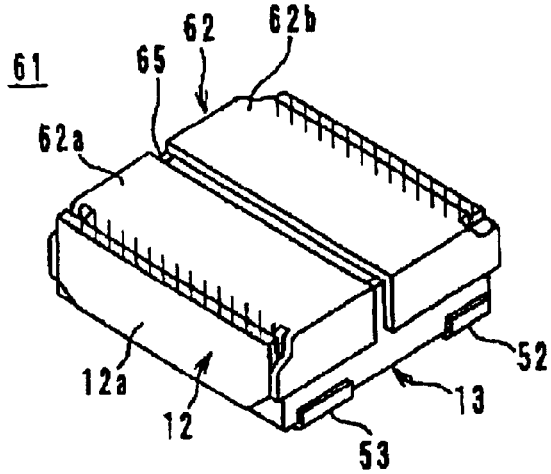
FIG. 8 is a perspective view showing the appearance of the nonreciprocal circuit device shown in FIG. 7.
Figure 9:
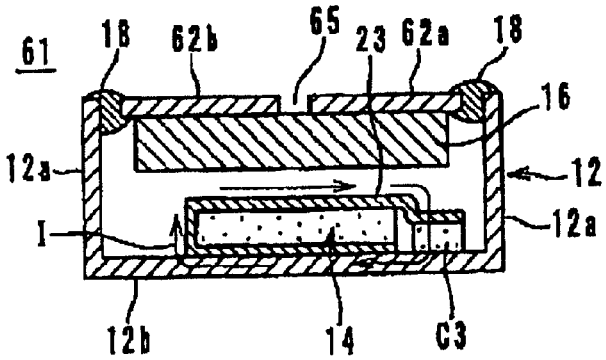
FIG. 9 is a schematic sectional view of the nonreciprocal circuit device shown in FIG. 7.

[Second Embodiment: FIGS. 7 to 9]

FIGS. 7 to 9 shows a nonreciprocal circuit device according to another embodiment of the present invention. A nonreciprocal circuit device 61 is equivalent to the lumped-constant isolator 11 described with reference to FIG. 13. However, in the nonreciprocal circuit device 61, a two-split upper case unit 62 is used as an alternative to the upper case unit 15.

The upper case unit 62 is constituted of a pair of members 62*a* and 62*b*, which are symmetrical to each other. The pair of members 62*a* and 62*b* are opposed each other leaving a gap 65 having a predetermined distance therebetween, and a permanent magnet 16 is attached on the inner surface of the upper case unit 62 constituted of the members 62*a* and 62*b*. Two edges at which the upper case unit 62 and the lower case unit 12 are close to each other (areas shown by oblique lines in FIG. 8) are connected by a solder 18 (see FIG. 9).

In the isolator 61 having the above arrangement, a high frequency current i flowing through the case units 12 and 62 is cut off by the gap 65. As a result, power consumption due to Joule loss can be suppressed.

Figure 10:
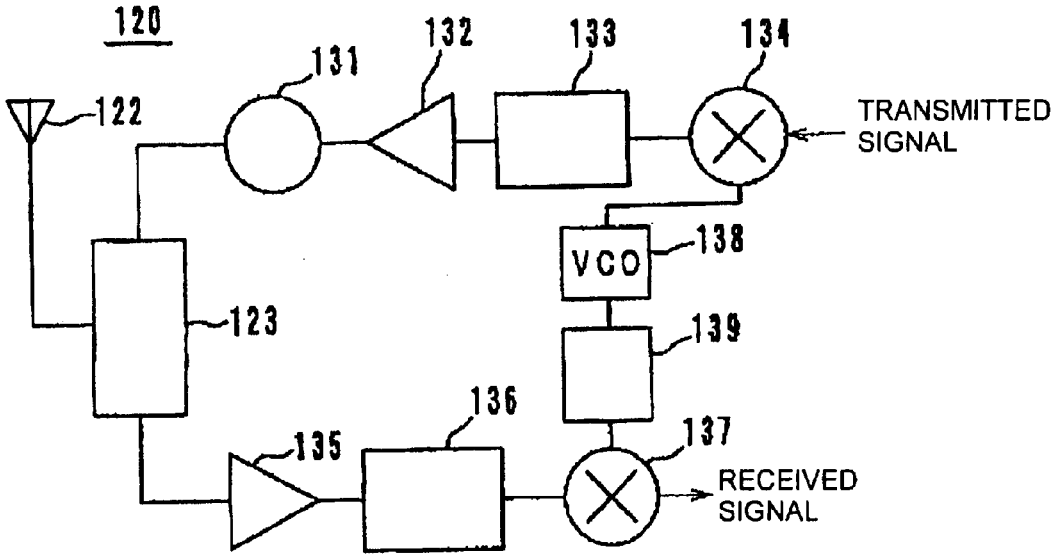
FIG. 10 is a block diagram of a communication apparatus according to an embodiment of the present invention.

[Third Embodiment: FIG. 10]

In the third embodiment of the present invention, a mobile phone as a communication apparatus in accordance with the present invention will be illustrated below.

FIG. 10 is an electric circuit block diagram of a RF section of a mobile phone 120. In FIG. 10, the reference numeral 122 denotes an antenna device, the reference numeral 123 denotes a duplexer, the reference numeral 131 denotes a transmission-side isolator, the reference numeral 132 denotes a transmission-side amplifier, and the reference numeral 133 denotes a transmission-side interstage band pass filter. The reference numeral 134 denotes a transmission-side mixer, the reference numeral 135 denotes a reception-side amplifier, the reference numeral 136 denotes a reception-side interstage band pass filter, the reference numeral 137 denotes a reception-side mixer, the reference numeral 138 denotes a voltage-controlled oscillator (VCO), and the reference numeral 139 denotes a local band pass filter.

In this case, as the transmission-side isolator 131, the lumped-constant isolator 41 of the first embodiment or the lumped-constant isolator 61 of the second embodiment can be used. With the use of one of these isolators 41 and 61, a mobile phone having good communication characteristics can be obtained.

[Other Embodiments]

Figure 11A:
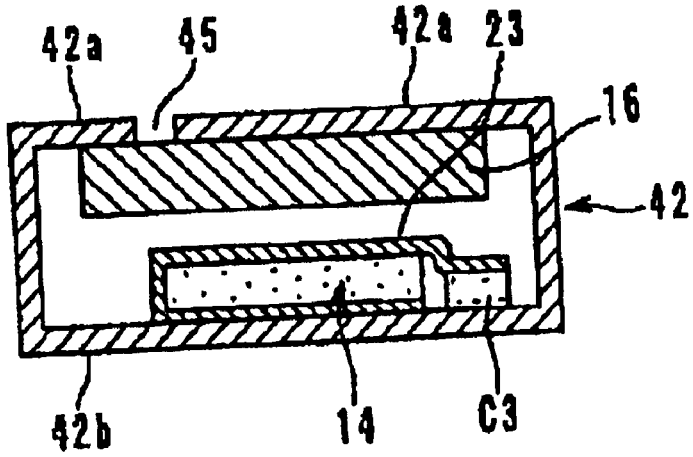
FIGS. 11A and 11B show schematic sectional views of a nonreciprocal circuit device according to a third embodiment of the present invention.
Figure 11B:
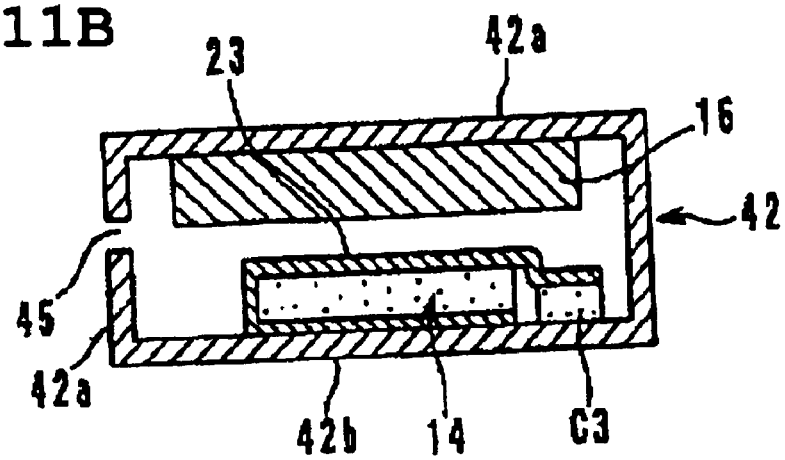
Figure 12:
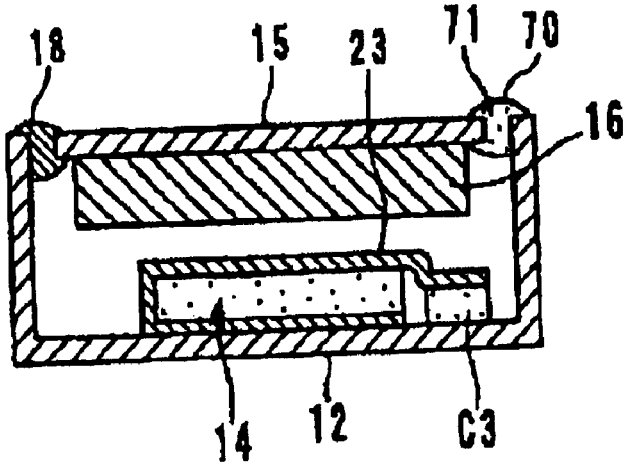
FIG. 12 is a schematic sectional view of a nonreciprocal circuit device according to a fourth embodiment of the present invention.
Figure 15:
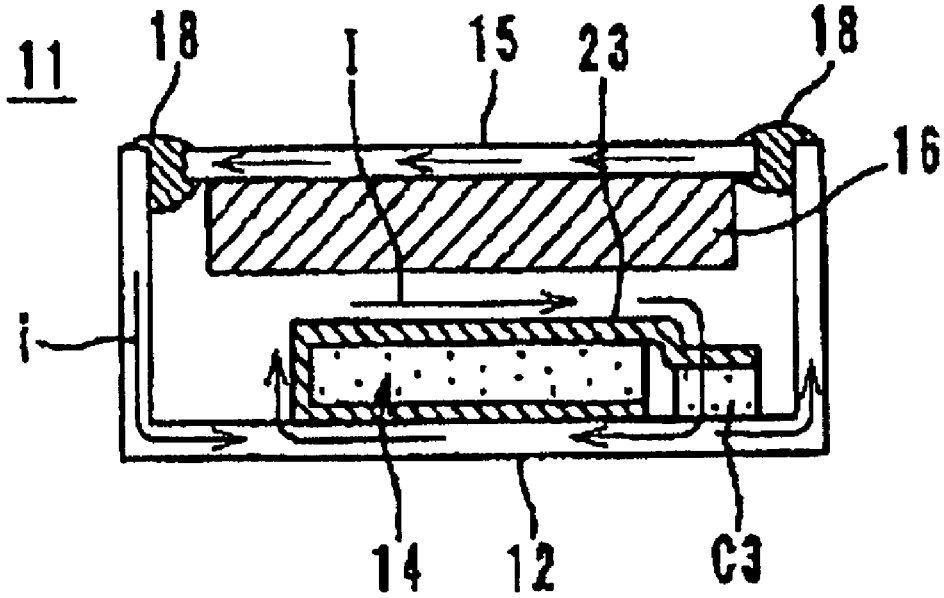
FIG. 15 PRIOR ART
FIG. 15 is a schematic sectional view of the nonreciprocal circuit device shown in FIG. 13.

The nonreciprocal circuit device and the communication apparatus according to the present invention are not restricted to the above embodiments. Various modifications and changes can be made without departing the scope and spirit of the invention. For example, in the isolator 41 of the first embodiment, it may not be necessary to dispose the gap 45 at the center of the top surface of the metal case 42. The gap 45 may be disposed in a position deviated from the center as shown in FIGS. 11A and 11B. In addition, as shown in FIG. 12, in a modification of the conventional isolator 11 (compare with FIG. 15), one of the edges of parts at which the upper case unit 15 and the lower case unit 12 are close to each other may be bonded with an insulating material 70 instead of a solder 18 to form a gap 71. When the edges of both parts are bonded with the insulating material, the direct current magnetic field of the central electrode assembly 14 is excessively reduced.

The nonreciprocal circuit device in accordance with the present invention can be adopted as other kinds of high frequency components such as circulators other than isolators. In addition, unlike the above central electrodes formed by punching out and folding a metal plate, alternatively, there may be provided the central electrodes formed by disposing pattern electrodes on a substrate such as a dielectric substrate, a magnetic substrate, or a multilayer substrate.

As described above, according to the present invention, since the metal case has a gap, the high frequency current flowing through the metal case is cut off by the gap. As a result, power consumption due to Joule loss can be suppressed.

In addition, although the high frequency current flowing through the metal case serves to reduce a high frequency magnetic field generated by the ferrite member, the gap of the metal case can prevent the reduction of the high frequency magnetic field. Therefore, since the effective magnetic permeability of the ferrite member and the effective inductances of the central electrodes increase, the operational frequency bandwidth of the nonreciprocal circuit device can be broadened. As a result, the nonreciprocal circuit device and the communication apparatus incorporating the same in accordance with the present invention can have good frequency characteristics.

What is claimed is:

1. A nonreciprocal circuit device comprising:

a permanent magnet;

a ferrite member which is arranged to receive a direct current magnetic field applied by the permanent magnet, said ferrite member including a plurality of central electrodes; and a metal case containing the permanent magnet, the ferrite member, and the plurality of central electrodes;

wherein the metal case has a gap containing a solid insulating material for cutting off a loop current flowing around the ferrite member and the plurality of central electrodes.

2. A nonreciprocal circuit device according to claim 1, wherein the metal case is formed by a plurality of components.

3. A nonreciprocal circuit device according to claim 1, wherein the metal case is 180° rotation-symmetric with respect to the axis of the permanent magnet.

4. A nonreciprocal circuit device according to claim 1, wherein the metal case is composed of an upper case unit and a lower case unit, and a gap is disposed at least between one edge of the upper case unit and one edge of the lower case unit opposite to the one edge of the upper case unit.

5. A communication apparatus comprising at least one of the nonreciprocal circuit devices according to claims 1 to 4.

6. A nonreciprocal circuit device according to claim 1, wherein the metal case is integrally formed.

7. A nonreciprocal circuit device according to claim 6, wherein a cross section of the metal case has a substantially rectangular frame shape formed by bending a substantially rectangular metal plate at four positions. In parallel to an edge of the metal plate.

* * * * *